US005286017A

United States Patent [19]

Hawk et al.

[11] Patent Number: 5,286,017

[45] Date of Patent: Feb. 15, 1994

[54] BILL ESCROW/RETURN DEVICE

[75] Inventors: Jeffrey L. Hawk, Hanover Park; Paul E. Stewart, Deerfield; W. Ludwik Lichodziejewski, Elk Grove, all of Ill.

[73] Assignee: ElectroCom Gard Ltd., Niles, Ill.

[21] Appl. No.: 30,913

[22] Filed: Mar. 15, 1993

[51] Int. Cl.[5] ..... B65H 5/22

[52] U.S. Cl. ..... 271/3.1; 271/180; 271/220; 194/206

[58] Field of Search ..... 271/3.1, 118, 177, 180, 271/181, 207, 209, 212, 220; 194/206, 207

[56] References Cited

U.S. PATENT DOCUMENTS

| | | | |
|---|---|---|---|
| 3,108,680 | 10/1963 | Ellis et al. | 198/31 |
| 3,447,655 | 6/1969 | Tanaka et al. | 194/4 |
| 3,783,989 | 1/1974 | Jensen | 194/4 G |
| 4,011,931 | 3/1977 | Wyckoff | 194/4 C |
| 4,540,081 | 9/1985 | Mori et al. | 194/207 |
| 4,682,768 | 7/1987 | Iida et al. | 271/3.1 |
| 4,736,852 | 4/1988 | Edin et al. | 209/534 |
| 4,747,493 | 5/1988 | Nakanishi | 209/534 |
| 4,784,274 | 11/1988 | Mori et al. | 209/534 |
| 4,889,220 | 12/1989 | Yoshinori et al. | 194/206 |
| 4,905,813 | 3/1990 | Rademacher | 194/217 |
| 5,076,418 | 12/1991 | Davila et al. | 194/206 |

FOREIGN PATENT DOCUMENTS

| | | | |
|---|---|---|---|
| 0058494 | 5/1979 | Japan | 271/180 |
| 0100062 | 8/1979 | Japan | 271/180 |
| 0235347 | 10/1986 | Japan | 271/180 |
| 0271354 | 10/1989 | Japan | 271/177 |
| 0271355 | 10/1989 | Japan | 271/177 |
| 0153490 | 6/1990 | Japan | 194/206 |
| 0295852 | 12/1990 | Japan | 271/177 |

*Primary Examiner*—D. Glenn Dayoan
*Assistant Examiner*—Carol Lynn Druzbick
*Attorney, Agent, or Firm*—Hill, Steadman & Simpson

[57] ABSTRACT

A bill escrow/return device is provided which includes a bill escrow chamber sized and positioned to receive a bill of a predetermined width, a bill pusher plate reciprocally mounted for movement into and out of the bill escrow chamber, a bill stacker unit for receiving the bill from the bill escrow chamber by means of the pusher plate upon confirmation of a vend transaction, and a bill return chute for deposit of the bill upon cancellation of the vend transaction. The bill escrow chamber has a first bill receiving area for receiving the bill in a vertical orientation, a wing stop member having an opening therethrough sized to allow passage of the bill pusher plate, yet smaller in width than the width of the bill, a pair of wings pivotally biased against the wing stop member, the wings laterally spaced apart a distance slightly less than a width of the bill pusher plate such that movement of the plate against the wings will cause the wings to pivot and move away from the wing stop member, a second bill receiving area defined between the wing stop member and the wings, and a bill drive mechanism for engaging and driving the bill from the second bill receiving area to the bill return chute.

26 Claims, 4 Drawing Sheets

FIG. 4
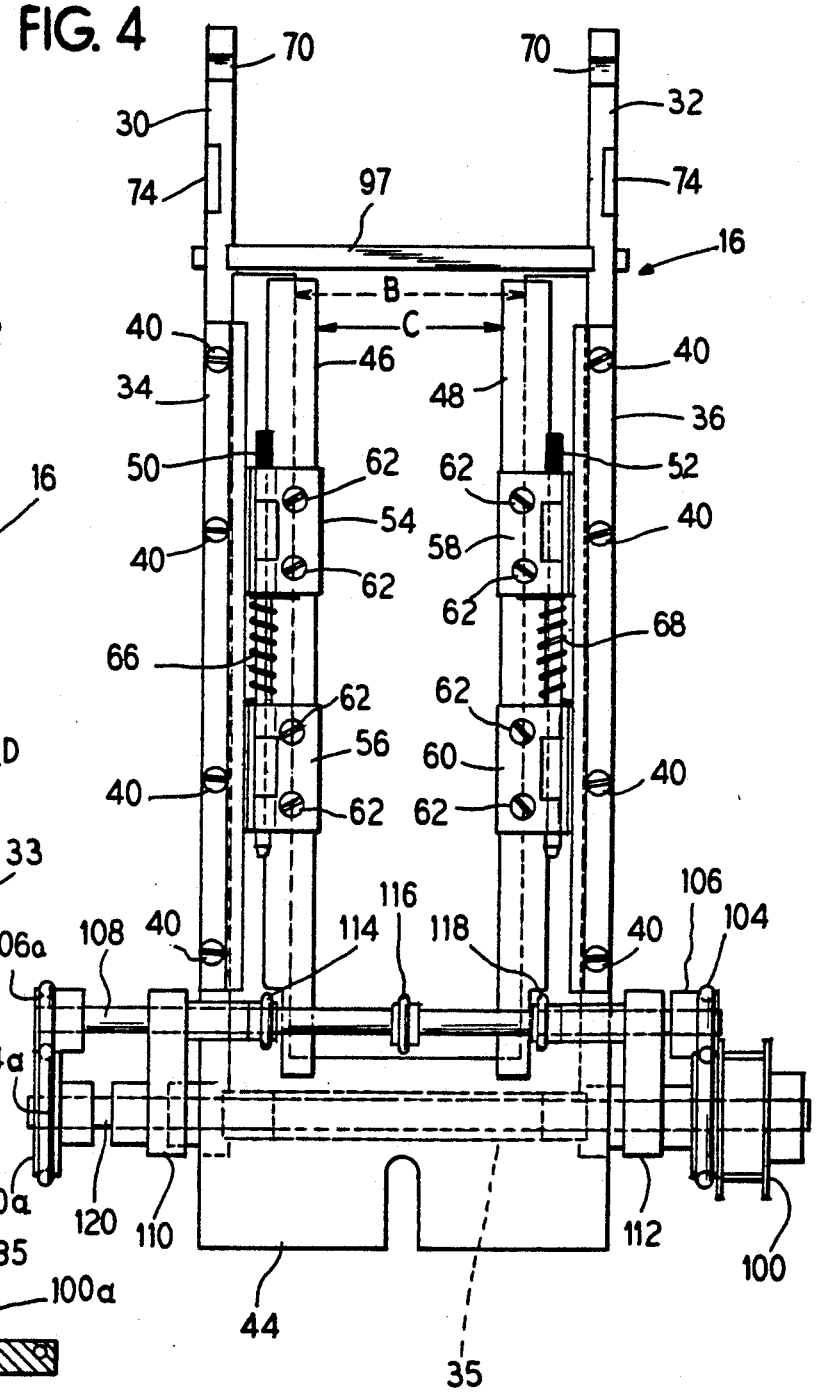
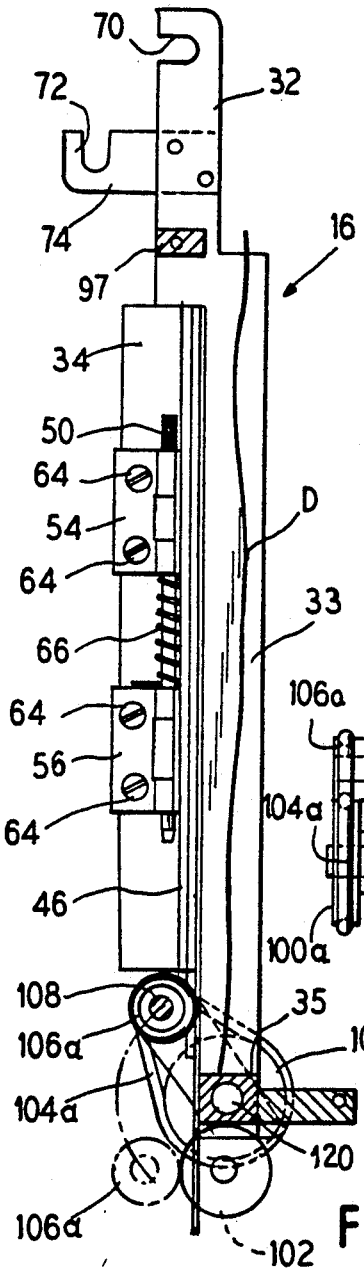
FIG. 3

BILL ESCROW/RETURN DEVICE

BACKGROUND OF THE INVENTION

The present invention relates to a bill escrow and return device for use in combination with a bill acceptor for a vending machine.

In the past vending machines have typically been operated by the use of one or a plurality of coins. However, more recently, vending machines have been equipped with bill acceptors for accepting paper money as well. With the increased use of bill acceptors in the vending industry and increased prices of items being vended, it becomes necessary to provide for the return of multiple customer inserted bills when the customer changes his mind about a bend before buying a product. In order to provide for the return of bills after they have been inserted into the vending device, it is necessary to utilize an escrow function. U.S. Pat. No. 4,540,081 discloses a bill accepting device which includes a bill discriminating section and an escrow section capable of retaining a bill accepted by the bill discrimination section and returning the retained bill. U.S. Pat. No. 5,076,413 discloses a multiple bill escrow and storage apparatus. In operation, a bill passes through a bill validator and into an escrow box. If the bills are to be returned, the escrow box is reciprocated from a handling station to an ejection station and a separate ejection device is disposed at the ejection station for ejecting the bill contained in the escrow box.

SUMMARY OF THE INVENTION

The present invention provides for an electromechanical device which can be used in a vending machine, for example, in conjunction with currency validators and currency retention systems. The device escrows bills inserted into a vending machine such that the bill or bills may be returned to the customer should the customer decide to cancel the transaction. The bills are stacked in a customer inaccessible location after the customer completes the transaction if he decides to purchase the vended product.

The bill accepting device utilizes a pre-stacker area of limited depth as an escrow unit. The escrow unit allows a customer the option of buying a product or changing his mind after inserting a single bill or a number of bills with a purchase up to some predetermined number of bills (preferably 10) comprising the thickness or the depth of the limited escrow unit. If the purchase is completed, the bills are moved from the escrow unit to a stacker using a pusher plate. If the customer decides not to purchase the product, the bills are released from the escrow unit and returned to the customer.

The bills in the escrow unit are under spring control to provide control of the bills during the transfer to the stacker or to the return area. A validator unit, the escrow unit, and the stacker are easily separable from each other, and the escrow unit may accommodate stackers of any capacity. Lever arm rollers and centered pinch rollers supply a stable drive mechanism for moving the bills to the return area, wherein the lever arm uses a three roller system to effectively gain control of the bills in the first stage of return. The centered pinch rollers provide an extra level of control over the bills for the exit from the mechanism through the return chute. An additional pusher motor behind a standard bill handler provides extended range and power for the stacking of bills. This motor pushes the plate from behind using a passive motion. Finally, a micro-computer provides control using optical sensors.

BRIEF DESCRIPTION OF THE DRAWINGS

FIG. 3 is a side elevational view of the bill escrow device in isolation.

FIG. 4 is a rear elevational view of the bill escrow chamber in isolation taken from the left side of FIG. 3.

DETAILED DESCRIPTION OF THE PREFERRED EMBODIMENTS

Figure 1:
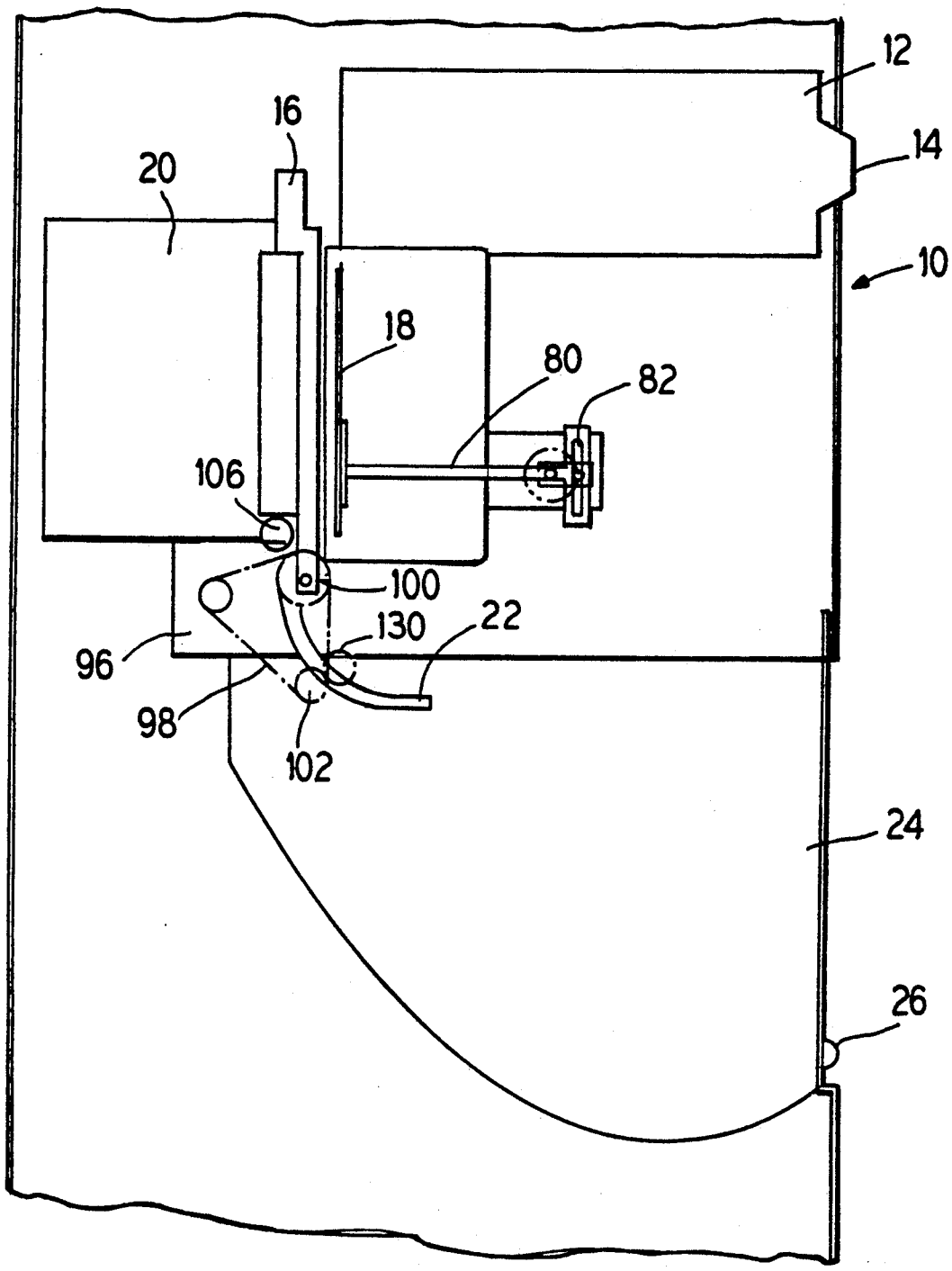
FIG. 1 is a side schematic illustration of the bill accepting device of the present invention including the bill validator, escrow chamber and stacker and return chamber.

FIG. 1 illustrates a bill accepting device which provides a useful environment for the present invention. The bill accepting device includes a bill validator mechanism 12 which may be any one of a number of commercially available bill validating devices, such as a bill validator manufactured by the Mars Corporation. Typically bills are inserted into an opening 14 where they are checked by the bill validator to verify that they are valid currency. Once the bills have been accepted, they pass through the bill validator 12 and are dispensed vertically downwardly into an area designated as an escrow chamber 16. This chamber is described in detail below, but it represents a space where one or more bills are held pending validation of the purchasing decision. If the vending machine user confirms the purchase, then a pusher plate 18 is activated to push the bills into a stacker 20 where they are retained until removed by authorized personnel.

If the user determines not to complete the purchase transaction, the bills in the escrow chamber 16 are dispensed downwardly along a chute 22 to be deposited into a return area 24 accessible through a door 26.

The escrow chamber 16 is shown in greater detail in FIGS. 2–6. A pair of side rails 30, 32 provide a lateral framework for the escrow chamber apparatus. The side rails 30, 32 define a first bill receiving chamber 33 bounded on the bottom by a flat sided bar 35 such that a bill D will be vertically received in the chamber 33 in a fixed vertical position. Secured onto the side rails 30, 32 are a pair of L-shaped guides 34, 36. The guides 34, 36 are secured to the side rails 30, 32 by appropriate fastening means such as screws 40. Sandwiched between the guides 34, 36 and the side rails 30, 32 is a wing stop plate 44.

Secured to each guide 34, 36 is a wing 46, 48. The wing 46, 48 is carried on a pivot pin 50, 52 through the interconnection of a pair of hinges 54, 56, 58, 60. The hinges 54, 56, 58, 60 are secured to the wings 46, 48 by appropriate fasteners such as screws 62 and the hinges are also connected by appropriate fasteners such as screws 64 to the guides 34, 36. The hinge pins 50, 52 each carry a spring 66, 68 which causes the wings 46, 48 to be biased against the wing stop 44.

Figure 2:
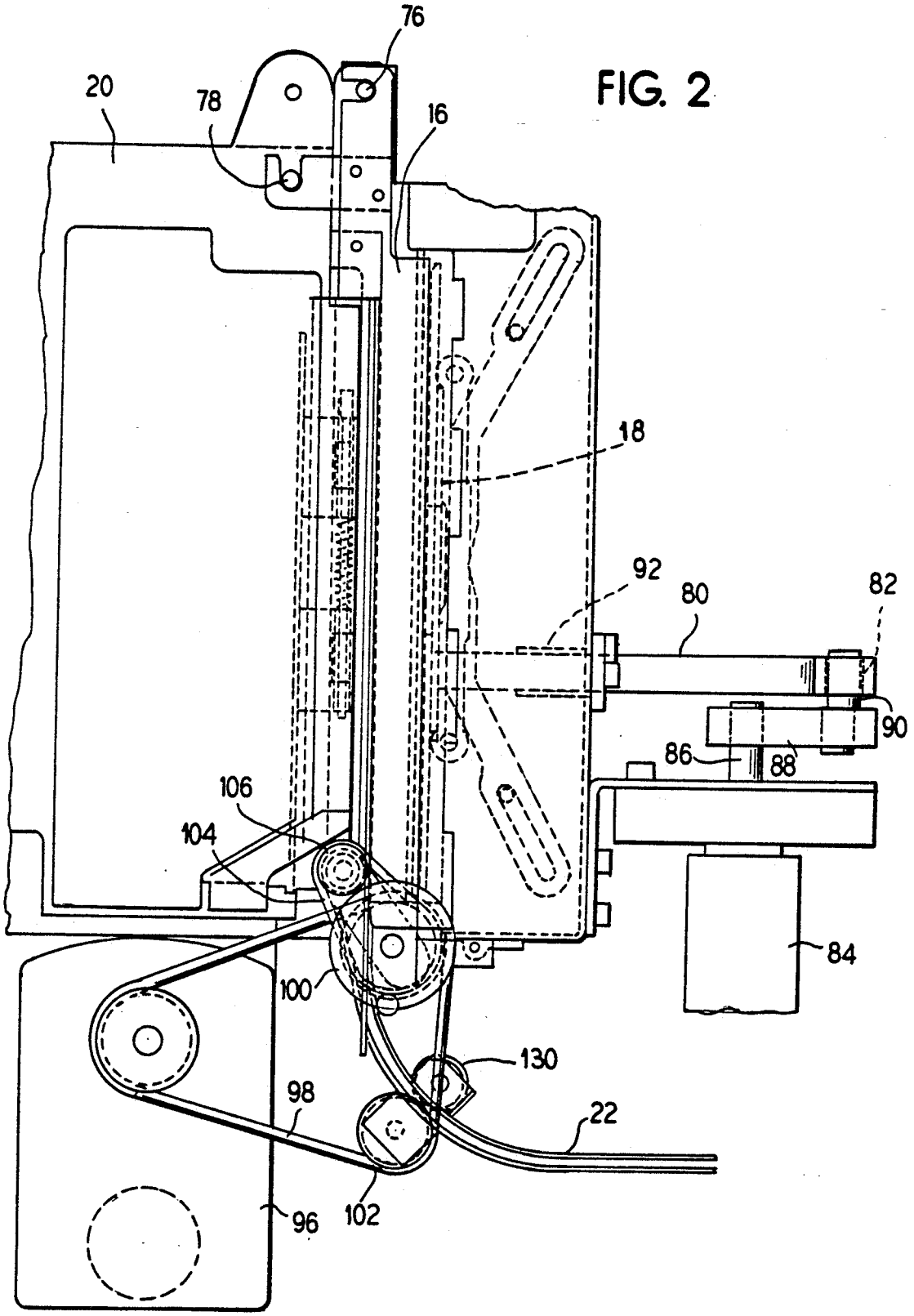
FIG. 2 is a side elevational view of the bill escrow portion of the device of FIG. 1.
Figure 5:
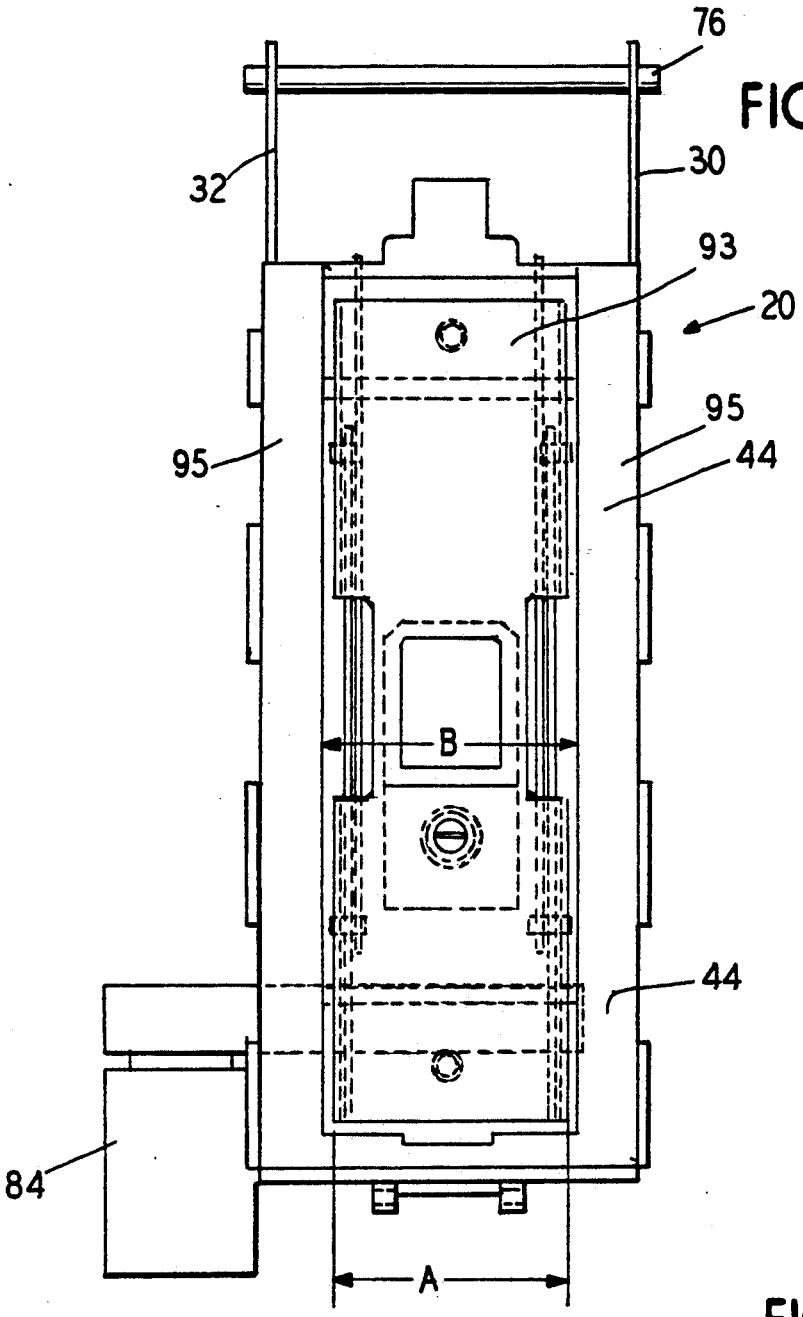
FIG. 5 is a rear sectional view taken through the bill escrow chamber and showing the bill pusher.

The escrow chamber 16 is carried on the stacker 22 by means of a first notch 70 in the side rails 30, 32 and a second notch 72 carried on a stacker hook 74 which is mounted to each side plate 30, 32. The slots 70, 72 are received on pins 76, 78 of the stacker 20 (FIG. 2).

The pusher plate 18 is carried on a pusher arm 80 which is in the form of a Scotch yoke having a lateral slot 82 (FIG. 1). A drive motor 84 has an output drive shaft 86 to which is connected a crank arm 88. A pin 90 extends upwardly from the crank arm 88 and extends into and is captured within the lateral slot 82 of the yoke 80. Thus, as the drive shaft 86 rotates, the yoke pusher arm 80 is caused to reciprocate. The pusher arm 80 is captured for linear reciprocating motion by means of a guide 92.

Figure 6:
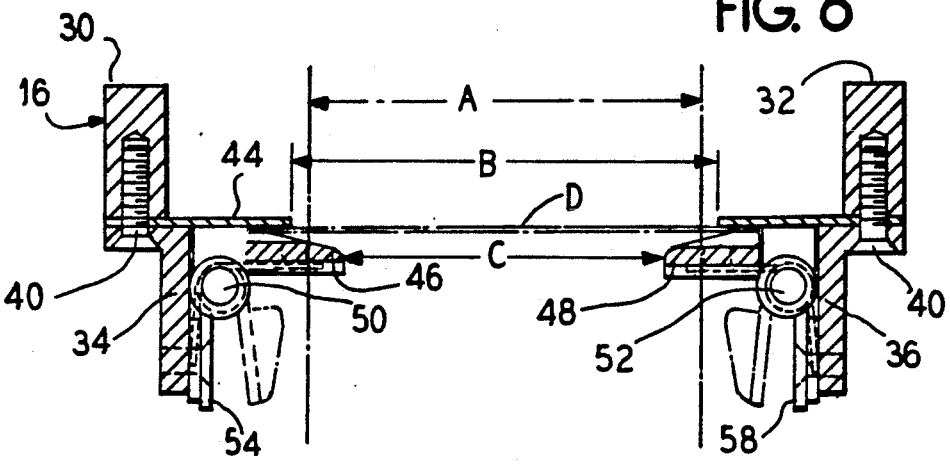
FIG. 6 is a top sectional view of the bill escrow unit of FIG. 3.

The pusher plate 18 has a generally rectangular face 93 which has a lateral dimension A (FIGS. 5, 6) less than a spacing B (FIGS. 4, 5, 6) between upright arm portions 95 of the wing stop 44, but greater than a lateral dimension C (FIGS. 4, 6) between the wings 46, 48. When bills D are received in the first bill receiving chamber 33 from the bill validator 12, the motor 84, under the direction of an electronic control and in response to signals received from sensors such as optical sensors, will operate to rotate the drive shaft 86 through only a part of one revolution so as to push the arm 80 and pusher 18 slightly into the space of the escrow chamber 16 pressing against nearly the full face of the bill and moving the bill beyond the wing stop 44, and into engagement with the wings 46, 48. The pusher plate 18 is then retracted by a reverse movement of the motor 84 and the springs 66, 68 press the wings 46, 48 back toward the wing stop 44, thus capturing the bill D between the wing stop and wings in a second bill receiving chamber defined between the wing stop and wings as illustrated in FIG. 6. A top cross bar 97 is positioned above the bar 35 a distance slightly less than a length of the bill D and the opening in the wing stop 44 defined by the spaced apart arms 95 terminates above the bar 35, thus providing top edge and bottom edge backing surfaces for the bills captured in the second bill receiving chamber. The flexibility of the bills allows them to move past the rigid arms 95, cross bar 97 and edge of the wing stop 44 when moved by the pusher plate 18, and the spring biased wings 46, 48 will hold the bills flat against those members upon retraction of the pusher plate. Thus, a number of bills are collected in this manner in the escrow chamber 16 pending a final approval of the vending operation.

When the vending operation is confirmed, the motor 84 cycles through a complete revolution causing the pusher plate 18 to push all the way past the wings 46, 48, thus pushing all of the collected escrow bills into the stacker 20. The stacker 20 has an opening similar in size to the opening of the wing stop 44 (width B), thus the bills are pushed through the stacker opening and are captured by the edges of the opening upon retraction of the pusher plate 18.

If the user determines not to proceed with the vending operation after one or more bills have been placed into the escrow chamber 16, a bill return mechanism comes into play. A second motor 96 is provided which is connected by means of a drive belt 98 to two drive wheels 100, 102. Drive wheel 100 is connected by a second belt 104 to a drive wheel 106. Drive wheel 106 is carried on a drive axle 108 which rotates with the drive wheel 106. To provide balance and a reliable drive mechanism, a second pair of drive wheels 100*a* and 106*a* are provided at an opposite side of the escrow chamber 16 and are connected by a drive belt 104*a*. The drive axle 108 is carried in a pair of bearings 110, 112 and centrally along the length of the shaft 108 are positioned three gripper wheels 114, 116 and 118. The two bearings 110, 112 comprise elongated arms which are pivotally carried on a shaft 120 which also carries the drive wheel 100. (The shaft 120 may be carried in the bar 35 which then also acts as a bearing.) When the drive belt 98 is rotated in a clockwise direction (as seen in FIG. 2) by the motor 96, rotation of the drive wheel 100 causes a following partial rotation of bearing arms 110, 112, thus causing the gripping wheels 114, 116, 118 to press into engagement with a rearward face of the rearmost bill which presses against the wings 46, 48. The gripper wheels 114, 116, 118 are rotated along with the drive wheel 106 causing the rearmost bill to be pulled downwardly from the escrow chamber and that one bill then is presented into the output chute 22. Gripper wheels 114, 118 overlie a portion of the wing stop 44 which provides a solid unyielding backing for the gripper wheels and allows for a clamping of the bills D held therebetween.

The drive wheel 102 presses against an idler wheel 130 forming a pinch point therebetween which also grips each bill as it passes along the discharge chute and causes the bill to be ejected from the end of the discharge chute into the space 24 where the bill can be retrieved by the user. As soon as the rearmost bill is ejected, the gripper wheels 114, 116, 118 will then engage the next most rearward bill and the process will continue until all of the bills have been ejected from the escrow chamber 16. Again, sensors and an appropriate electronic control will provide the required energization and de-energization of the discharge motor 96. Just prior to de-energization of the discharge motor 96, it is reversed causing bearing arms 110, 112 to pivot away from the gripping position to a standby position indicated by dashed lines in FIG. 3 to prevent any hinderance of bills moving into the second bill receiving chamber.

Thus, it is seen that the bill escrow device of the present invention provides a very simple and uncomplicated mechanism for holding a plurality of bills pending confirmation of a vending selection and allowing for return of the escrowed bills and also allowing for movement of the escrowed bills into a stacker mechanism if the vend decision has been confirmed. This escrow device can be attached to a stacker device of any size or capacity.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A bill escrow/return device comprising:

a bill escrow chamber sized and positioned to receive a bill of a predetermined width;

a bill pusher plate reciprocally mounted for movement into and out of said bill escrow chamber;

a bill stacker unit for receiving said bill from said bill escrow chamber by means of said pusher plate upon confirmation of a vend transaction; and a bill return chute for deposit of said bill upon cancellation of said vend transaction;

said bill escrow chamber having means for securing said bill escrow chamber in a fixed vertical position relative to said bill pusher plate and said bill stacker unit during operation of said bill escrow/return device and also having a first bill receiving area for receiving said bill in a vertical orientation;

a wing stop member having an opening therethrough sized to allow passage of said bill pusher plate, yet smaller in width than said width of said bill;

a pair of wings pivotally biased against said wing stop member, said wings laterally spaced apart a distance slightly less than a width of said bill pusher plate such that movement of said plate against said wings will cause said wings to pivot and move away from said wing stop member;

a second bill receiving area defined between said wing stop member and said wings, and a bill drive mechanism for engaging and driving said bill from said second bill receiving area to said bill return chute without vertically moving said bill escrow chamber.

2. A bill escrow/return device according to claim 1, wherein said bill receiving area is defined by a pair of laterally spaced apart rails forming a frame for said bill escrow chamber.

3. A bill escrow/return device according to claim 1, wherein said bill receiving area includes a bottom stop member for supporting said bill in a fixed vertical position.

4. A bill escrow/return device according to claim 1, wherein said wing stop member comprises a pair of vertical arms defining said opening therebetween.

5. A bill escrow/return device according to claim 1, wherein said wings each comprise an elongated vertical plate pivotally mounted by means of a hinge.

6. A bill escrow/return device according to claim 5, wherein said hinges include torsion springs to bias said wings against said wing stop member.

7. A bill escrow/return device comprising:

a bill escrow chamber sized and positioned to receive a bill of a predetermined width;

a bill pusher plate reciprocally mounted for movement into and out of said bill escrow chamber;

a bill stacker unit for receiving said bill from said bill escrow chamber by means of said pusher plate upon confirmation of a vend transaction; and a bill return chute for deposit of said bill upon cancellation of said vend transaction;

said bill escrow chamber having a first bill receiving area for receiving said bill in a vertical orientation;

a wing stop member having an opening therethrough sized to allow passage of said bill pusher plate, yet smaller in width than said width of said bill;

a pair of wings pivotally biased against said wing stop member, said wings laterally spaced apart a distance slightly less than a width of said bill pusher plate such that movement of said plate against said wings will cause said wings to pivot and move away from said wing stop member;

a second bill receiving area defined between said wing stop member and said wings, and a bill drive mechanism for engaging and driving said bill from said second bill receiving area to said bill return chute;

said bill drive mechanism including at least one rotatable gripping wheel engageable with said bill to move said bill from said second bill receiving area.

8. A bill escrow/return device according to claim 7, wherein said gripping wheel is carried on an axle which is pivotable toward and away from said second bill receiving area.

9. A bill escrow/return device according to claim 8, wherein said axle carries a plurality of gripping wheels.

10. A bill escrow/return device according to claim 8, wherein said axle is pivoted toward said second bill receiving area upon rotation of said gripping wheel.

11. A bill escrow/return device according to claim 7, wherein said gripping wheel overlies a portion of said wing stop member which provided a backing support for said bill when said gripping wheel engages said bill.

12. A bill escrow/return device according to claim 7, wherein said bill drive mechanism comprises at least two opposed gripping wheels for engaging and driving a bill inserted therebetween.

13. A bill escrow/return device comprising:

a bill escrow chamber sized and positioned to receive a bill of a predetermined width;

a bill pusher plate reciprocally mounted for movement into and out of said bill escrow chamber;

a bill stacker unit for receiving said bill from said bill escrow chamber by means of said pusher plate upon confirmation of a vend transaction; and a bill return chute for deposit of said bill upon cancellation of said vend transaction;

said bill escrow chamber having a first bill receiving area for receiving said bill in a vertical orientation;

a wing stop member having an opening therethrough sized to allow passage of said bill pusher plate, yet smaller in width than said width of said bill;

a pair of wings pivotally biased against said wing stop member, said wings laterally spaced apart a distance slightly less than a width of said bill pusher plate such that movement of said plate against said wings will cause said wings to pivot and move away from said wing stop member;

a second bill receiving area defined between said wing stop member and said wings, and a bill drive mechanism for engaging and driving said bill from said second bill receiving area to said bill return chute;

said bill pusher plate being carried on an arm which has a yoke thereon for receiving a crank pin driven by an electric motor, wherein movement of said crank pin causes reciprocating movement of said pusher plate.

14. A bill escrow/return device according to claim 13, wherein said crank pin is carried on the end of a crank arm secured to a drive shaft of said motor, and partial rotation of said drive shaft will cause said pusher plate to move into said bill escrow chamber and full rotation of said drive shaft will cause said pusher plate to move through both bill receiving areas in said bill escrow chamber.

15. A bill escrow chamber comprising:

a first bill receiving area for receiving a bill of a predetermined width in a vertical orientation;

a wing stop member having an opening therethrough sized slightly smaller in width than said width of said bill;

a pair of wings pivotally biased against said wing stop member, said wings laterally spaced apart a distance slightly less than a width of said wing stop member opening;

a second bill receiving area defined between said wing stop member and said wings; and a bill drive mechanism for engaging and driving said bill vertically from said second bill receiving area without vertically moving said bill escrow chamber.

16. A bill escrow/return device according to claim 15, wherein said bill receiving area is defined by a pair of laterally spaced apart rails forming a frame for said bill escrow chamber.

17. A bill escrow/return device according to claim 15, wherein said bill receiving area includes a bottom stop member for supporting said bill in a fixed vertical position.

18. A bill escrow/return device according to claim 15, wherein said wing stop member comprises a pair of vertical arms defining said opening therebetween.

19. A bill escrow/return device according to claim 15, wherein said wings each comprise an elongated vertical plate pivotally mounted by means of a hinge.

20. A bill escrow/return device according to claim 19, wherein said hinges include torsion springs to bias said wings against said wing stop member.

21. A bill escrow chamber comprising:

a first bill receiving area for receiving a bill of a predetermined width in a vertical orientation;

a wing stop member having an opening therethrough sized slightly smaller in width than said width of said bill;

a pair of wings pivotally biased against said wing stop member, said wings laterally spaced apart a distance slightly less than a width of said wing stop member opening;

a second bill receiving area defined between said wing stop member and said wings; and a bill drive mechanism for engaging and driving said bill vertically from said second bill receiving area;

said bill drive mechanism including at least one rotatable gripping wheel engageable with said bill to move said bill from said second bill receiving area.

22. A bill escrow chamber according to claim 21, wherein said gripping wheel is carried on an axle which is pivotable toward and away from said second bill receiving area.

23. A bill escrow chamber according to claim 22, wherein said axle carries a plurality of gripping wheels.

24. A bill escrow chamber according to claim 22, wherein said axle is pivoted toward said second bill receiving area upon rotation of said gripping wheel.

25. A bill escrow chamber according to claim 21, wherein said gripping wheel overlies a portion of said wing stop member which provided a backing support for said bill when said gripping wheel engages said bill.

26. A bill escrow/return device comprising:

a bill escrow chamber sized and positioned to receive a bill of a predetermined width;

a bill pusher plate reciprocally mounted for movement into and out of said bill escrow chamber;

a bill stacker unit for receiving said bill from said bill escrow chamber by means of said pusher plate upon confirmation of a vend transaction; and a bill return chute for deposit of said bill upon cancellation of said vend transaction;

said bill escrow chamber having a first bill receiving area for receiving said bill in a vertical orientation defined by a pair of laterally spaced apart rails forming a frame for said bill escrow chamber and including a bottom stop member for supporting said bill in a fixed vertical position;

a wing stop member comprising a pair of vertical arms defining an opening therebetween sized to allow passage of said bill pusher plate, yet smaller in width than said width of said bill;

a pair of wings each comprising an elongated vertical plate pivotally mounted by means of a hinge which include torsion springs to bias said wings against said wing stop member, said wings laterally spaced apart a distance slightly less than a width of said bill pusher plate such that movement of said plate against said wings will cause said wings to pivot and move away from said wing stop member;

a second bill receiving area defined between said wing stop member and said wings; and a bill drive mechanism for engaging and driving said bill from said second bill receiving area to said bill return chute including a plurality of rotatable gripping wheels carried on an axle which is pivotable toward and away from said second bill receiving area, said wheels being engageable with said bill to move said bill from said second bill receiving area.

* * * * *

UNITED STATES PATENT AND TRADEMARK OFFICE

CERTIFICATE OF CORRECTION

PATENT NO. : 5,286,017

DATED : February 15, 1994

INVENTOR(S) : Jeffrey Lynn Hawk, Paul Eugene Stewart and W. Ludwik Lichodziejewski It is certified that error appears in the above-indentified patent and that said Letters Patent is hereby corrected as shown below:

Column 1, line 16 "bend" should read --vend--.

Signed and Sealed this

Tenth Day of October, 1995

*Attest:*

*Attesting Officer*

BRUCE LEHMAN

*Commissioner of Patents and Trademarks*